US008973185B2

(12) United States Patent
Dewert et al.

(10) Patent No.: US 8,973,185 B2
(45) Date of Patent: Mar. 10, 2015

(54) SUPPORT DEVICE WHICH IS ADJUSTABLE BY AN ELECTRIC MOTOR

(75) Inventors: Eckhart Dewert, Goldingen (CH); Jörg Henle, Giebelstadt-Allersheim (DE)

(73) Assignee: Bionical Systems AG, Zürich (CH)

( * ) Notice: Subject to any disclaimer, the term of this patent is extended or adjusted under 35 U.S.C. 154(b) by 406 days.

(21) Appl. No.: 13/275,033

(22) Filed: Oct. 17, 2011

(65) Prior Publication Data

US 2012/0054963 A1 Mar. 8, 2012

Related U.S. Application Data

(63) Continuation of application No. PCT/EP2010/002062, filed on Mar. 31, 2010.

(30) Foreign Application Priority Data

Apr. 17, 2009 (DE) ..... 10 2009 017 895

(51) Int. Cl.
*A47C 20/08* (2006.01)
*A47C 20/04* (2006.01)

(52) U.S. Cl.
CPC ..... *A47C 20/08* (2013.01); *A47C 20/041* (2013.01)
USPC ..... 5/600; 5/613; 5/616

(58) Field of Classification Search
USPC ..... 5/600, 613, 616
See application file for complete search history.

(56) References Cited

U.S. PATENT DOCUMENTS 945,449 A 1/1910 Edgoombe
1,601,983 A 10/1926 Savage
3,050,902 A 8/1962 Glass et al.
3,191,196 A 6/1965 Holm
4,101,120 A 7/1978 Seshima
4,236,711 A 12/1980 Klingbeil
(Continued)

FOREIGN PATENT DOCUMENTS

CH 607 682 10/1978
DE 299 04 356 6/1999
(Continued)

OTHER PUBLICATIONS

Written Opinion of the International Searching Authority dated Sep. 3, 2010 in PCT/EP2010/002062, (6 pgs.).
(Continued)

*Primary Examiner* — Robert G Santos
*Assistant Examiner* — Ifeolu Adeboyejo
(74) *Attorney, Agent, or Firm* — Shlesinger, Arkwright & Garvey LLP

(57) ABSTRACT

Support device, which is adjustable by an electric motor, for cushioning of a piece of furniture for sitting and/or lying on has a first support part, and a second support part pivotable about a pivot axis, between which a third support part is provided. Support device has an electric motor drive which has an adjusting element connected in a force-transmitting manner to the second support part by an actuating element for pivoting second support part. Actuating element has a rod-like configuration, by which the adjusting element is guided in a linearly displaceable manner in guide formed on third support part. Actuating element engages with second support part for pivoting the second support part eccentrically relative to pivot axis.

13 Claims, 17 Drawing Sheets

(56) References Cited

U.S. PATENT DOCUMENTS

| | | | | |
|---|---|---|---|---|
| 4,517,967 | A | 5/1985 | Timm et al. | |
| 4,724,716 | A | 2/1988 | Kawai | |
| 5,098,343 | A | 3/1992 | Tysver et al. | |
| 5,183,427 | A | 2/1993 | Draper | |
| 5,306,199 | A | 4/1994 | Locricchio | |
| 5,326,369 | A | 7/1994 | Schectman | |
| 5,456,568 | A | 10/1995 | Kirby et al. | |
| 5,675,849 | A | 10/1997 | Koch | |
| 5,829,077 | A | 11/1998 | Neige | |
| 6,000,077 | A | 12/1999 | Cyr | |
| 6,138,604 | A | 10/2000 | Anderson et al. | |
| 6,619,146 | B2 | 9/2003 | Kerrebrock | |
| 6,622,323 | B2 | 9/2003 | Zerhusen et al. | |
| 6,647,569 | B1 | 11/2003 | Tansek | |
| 6,877,816 | B1 | 4/2005 | Farmont | |
| 7,055,195 | B2 | 6/2006 | Roussy | 5/616 |
| 2006/0130236 | A1 | 6/2006 | Dewert et al. | |
| 2007/0067913 | A1 | 3/2007 | Dewert et al. | |
| 2008/0250562 | A1 | 10/2008 | Tekulve | |
| 2008/0271246 | A1 | 11/2008 | Nielsen et al. | |

FOREIGN PATENT DOCUMENTS

| | | | |
|---|---|---|---|
| DE | 299 17 813 | | 2/2001 |
| DE | 299 17 813 | U1 | 3/2001 |
| DE | 199 62 539 | | 11/2001 |
| DE | 202 05 337 | | 9/2003 |
| DE | 202 10 187 | U1 | 12/2003 |
| DE | 10 2004 016 048 | A1 | 4/2004 |
| DE | 10 2006 030 674 | | 1/2008 |
| DE | 20 2007 015 811 | U1 | 4/2009 |
| EP | 0 604 242 | | 6/1994 |
| EP | 1 767 122 | | 3/2007 |
| FR | 2 855 730 | | 12/2004 |
| FR | 2 901 817 | | 12/2007 |
| WO | WO 96/12427 | | 5/1996 |
| WO | WO 2010/118827 | | 10/2010 |
| WO | WO 2010/118828 | A1 | 10/2010 |
| WO | WO 2010/118829 | | 10/2010 |
| WO | WO 2010/118830 | | 10/2010 |

OTHER PUBLICATIONS

International Search Report (ISR) dated Sep. 3, 2010 in PCT/EP2010/002062, (3 pgs.).
U.S. Appl. No. 13/275,067, filed Oct. 2011, Dewert et al.
U.S. Appl. No. 13/275,086, filed Oct. 2011, Dewert et al.
U.S. Appl. No. 13/275,056, filed Oct. 2011, Dewert et al.
Written Opinion of the International Searching Authority dated Sep. 3, 2010 in PCT/EP2010/002088, (6 pgs.).
International Search Report (ISR) dated Sep. 3, 2010 in PCT/EP2010/002088, (2 pgs.).
Written Opinion of the International Searching Authority dated Sep. 3, 2010 in PCT/EP2010/002060, (5 pgs.).
International Search Report (ISR) dated Sep. 3, 2010 in PCT/EP2010/002060, (2 pgs.).
Written Opinion of the International Searching Authority dated Sep. 6, 2010 in PCT/EP2010/002063, (5 pgs.).
International Search Report (ISR) dated Sep. 6, 2010 in PCT/EP2010/002063, (3 pgs.).

SUPPORT DEVICE WHICH IS ADJUSTABLE BY AN ELECTRIC MOTOR

CROSS-REFERENCE TO RELATED APPLICATIONS

This application is a continuation of application no. PCT/EP2010/002062, filed Mar. 31, 2010, which claims the priority of German application no. 10 2009 017 895.3, filed Apr. 17, 2009, and each of which is incorporated herein by reference.

FIELD OF THE INVENTION

The invention relates to a support device, which is adjustable by an electric motor, for cushioning of a piece of furniture for sitting and/or lying on.

BACKGROUND OF THE INVENTION

Such support devices, for example in the form of slatted bed frames which are adjustable by an electric motor, are generally known, for example from EP 0 372 032 B1 and DE 199 62 541 C3.

A support device, which is adjustable by an electric motor, of the type in question for cushioning of a piece of furniture for sitting and/or lying on is known from DE 38 42 078 C2. The known support device has a first support part and a second support part which is pivotable about a pivot axis, between which a third support part is provided. In the known support device, the first support part is a stationary support part, while the second support part is a head support part, and the third support part provided between the first support part and the second support part is an upper body support part. The known support device has an electric motor drive which has an adjusting element that is connected in a force-transmitting manner to the second support part via an actuating element in order to pivot the second support part. In the known support device, the second support part is connected in a rotationally fixed manner to a rotationally supported shaft which is connected in a rotationally fixed manner to a coupling lever. In the known support device, the adjusting element is a slide rod which is connected to a spindle nut of a spindle drive. When the known support device is operated, the slider pushes against the coupling lever, so that the shaft which is connected to the second support part is rotated. The second support part is pivoted in this manner.

OBJECTS AND SUMMARY OF THE INVENTION

An object of the invention is to provide a support device, which is adjustable by an electric motor, for cushioning of a piece of furniture for sitting and/or lying on, having a simplified and therefore more cost-effective configuration, and an overall height which is kept small.

This object is achieved by the invention as set forth herein.

The invention includes a support device, which is adjustable by an electric motor, for cushioning of an item of furniture for one of sitting and lying on, which includes:

a) a first support part, and a second support part which is pivotable about a pivot axis, between which a third support part is provided;

b) an electric motor drive which has an adjusting element that is connected in a force-transmitting manner to the second support part via an actuating element in order to pivot the second support part;

c) the actuating element having a rod-like configuration, by which the adjusting element is guided in a linearly displaceable manner in a guide formed in or on one of the first, second, and third support parts; and d) the actuating element engaging with the second support part in order to pivot the second support part eccentrically with respect to the pivot axis.

According to the invention, the actuating element has a rod-like configuration, and by means of the adjusting element is guided in a linearly displaceable manner in a guide which is preferably formed in or on the third support part. According to the invention, the actuating element engages with the second support part in order to pivot the second support part eccentrically with respect to the pivot axis. According to the invention, the second support part may be pivoted, for example and in particular, in that the actuating element, which may be configured in the manner of a pusher, for example, pushes against the second support part eccentrically with respect to the pivot axis. In this manner, firstly a coupling lever to be connected to a pivot shaft is no longer necessary, so that a support device according to the invention has a simplified, more cost-effective configuration. Secondly, for a support device according to the invention, a rotationally fixed connection of the support part, which is to be pivoted, to a pivot shaft is no longer necessary.

Since the rod-like actuating element, for example and in particular, may be supported in a guide which is formed in the third support part, the components necessary for introducing an adjustment force into the second support part do not increase the overall height of the support device. Thus, the overall height is significantly reduced compared to known support devices.

On the whole, this results in a simple, cost-effective, and robust configuration having few components, and at the same time having a lower overall height.

The support device according to the invention may, for example, be a slatted frame which is used for supporting a bed mattress. However, the support device according to the invention may also be, for example, a recliner, in particular an outdoor lounge recliner, or any other given item of furniture for sitting and/or lying on.

One extremely advantageous further embodiment of the invention provides at least one further support part which is pivotable about a pivot axis, a further actuating element being associated with the further support part and being guided in a linearly displaceable manner in a guide formed in or on the support part adjacent to the further support part, the further actuating element engaging with the further support part in order to pivot the further support part eccentrically with respect to its pivot axis. This embodiment uses the basic principle according to the invention for simultaneously or successively pivoting multiple support parts.

One extremely advantageous further embodiment of the invention provides that at least one support part at a distance from the guide of an actuating element guided on the support part has a contact surface, whereby in a first kinematic phase an active surface of the adjusting element or of an actuating element provided at an adjacent support part comes into contact with the actuating element and linearly displaces same, and in a second kinematic phase the active surface of the adjusting element or of the actuating element provided at the adjacent support part comes into contact with the contact surface of the support part, eccentrically with respect to its pivot axis, and pivots the support part about the pivot axis. In this embodiment, for example, a head support part and an upper body support part may be moved relative to a stationary support part by means of a particularly simple configuration.

In the first kinematic phase the adjusting element, for example a slider of a spindle drive provided on the stationary support part, linearly displaces an actuating element which is guided on the upper body support part. The actuating element engages with the head support part, eccentrically with respect to the associated pivot axis, thus pivoting the head support part when the actuating element is linearly displaced. As soon as the slider comes into contact with the contact surface of the upper body support part, the actuating element is not further linearly displaced, so that the head support part is not further pivoted. Instead, in the second kinematic phase the slider pushes against the upper body support part, eccentrically with respect to the associated rotational axis, so that the upper body support part, together with the already pivoted head support part, is pivoted. The corresponding kinematics of the support parts are thus achieved using only a few components.

Another extremely advantageous further embodiment of the invention provides that the adjusting element acts on at least one actuating element, and/or at least one actuating element acts on an adjacent actuating element, and/or at least one actuating element acts on the associated support part, with play. This embodiment is particularly advantageous when the force-transmitting components in the drive train of the support device are subjected to pressure during the pivoting of a support part or multiple support parts. However, if the force-transmitting components or at least one of these components is/are subjected to traction during the pivoting of a support part, the adjusting element may be fixedly connected to an actuating element, or an actuating element may be fixedly connected to an adjacent actuating element, or an actuating element may be fixedly connected to the associated support part.

Another advantageous further embodiment of the invention provides that at least one actuating element is subjected to pressure during the pivoting of the associated support part. This results in a particularly simple configuration, since in particular the actuating element is able to act on the associated support part with play.

According to another advantageous further embodiment, at least one actuating element is configured in the manner of a pusher.

The adjusting element may be provided in any desired suitable manner, preferably by the drive element of a linear drive. In this regard, one advantageous further embodiment of the invention provides that the adjusting element is a spindle nut, or is connected to a spindle nut, which is provided on a rotationally drivable threaded spindle so as to be movable in a non-twisting manner in the axial direction. Such spindle drives are available as simple, robust standard components, and are suitable for transmitting large forces.

One advantageous further embodiment, in particular the embodiment in which at least one actuating element is subjected to pressure during the pivoting of the associated support part, provides that the adjusting element is configured as a slider. In combination with the previously described embodiment, the slider may be formed by the spindle nut or connected to the spindle nut.

Another extremely advantageous further embodiment of the invention provides that the lengths of the actuating elements, and in each case the distance of the active surface of an actuating element from the contact surface of the associated support part in an unadjusted position of the support parts, are dimensioned in such a way that the support parts pivot in succession. In this manner a particularly ergonomic adjustment is achievable in which, for example, first a head support part is pivoted, and subsequently an upper body support part of a slatted frame is pivoted. The number of support parts is selectable within a wide range in all embodiments of a support device according to the invention.

Another further embodiment of the invention provides that the lengths of the actuating elements, and in each case the distance of the active surface of an actuating element from the contact surface of the associated support part in the unadjusted position of the support parts, are dimensioned in such a way that the support parts pivot simultaneously or essentially simultaneously.

In the sense of a simple and cost-effective configuration, using the smallest possible number of different components, another advantageous further embodiment provides that the actuating elements are essentially the same length.

Another further embodiment of the invention provides that in an unadjusted position, the distance of the active surface of an actuating element from the contact surface of the associated support part decreases from the actuating element closest to the adjusting element to the actuating element farthest from the adjusting element. When the actuating elements have essentially the same length, in this embodiment kinematics result in which the support part which is farthest from the adjusting element, and thus from the drive, pivots first, and subsequently the support parts closer to the drive pivot in succession.

Another advantageous further embodiment of the invention provides that the support device is configured as a slatted frame in which the support parts have elastic slats for supporting a bed mattress.

Another further embodiment of the invention provides that the support device is configured as a recliner, in particular an outdoor lounge recliner.

The number of support parts is selectable within a wide range, depending on the particular requirements. Depending on the particular requirements, for example, a support device having a single adjustable support part or also a support device having a plurality of mutually adjustable support parts may be implemented.

The invention is explained in greater detail below with reference to the accompanying drawings, which illustrate embodiments of a support device according to the invention. All features that are described, illustrated in the drawings, and set forth in the claims constitute the subject matter of the invention, taken alone or in any given combination, independently of their combination in the claims and their dependencies, and independently of their description or illustration in the drawings.

Relative terms, such as left, right, up, and down, are for convenience only and are not intended to be limiting.

BRIEF DESCRIPTION OF THE DRAWINGS

FIGS. 6A-6G show, in a partially sectional side view, the support device according to FIG. 5 in various adjustment positions.

DETAILED DESCRIPTION OF THE INVENTION

Figure 1:
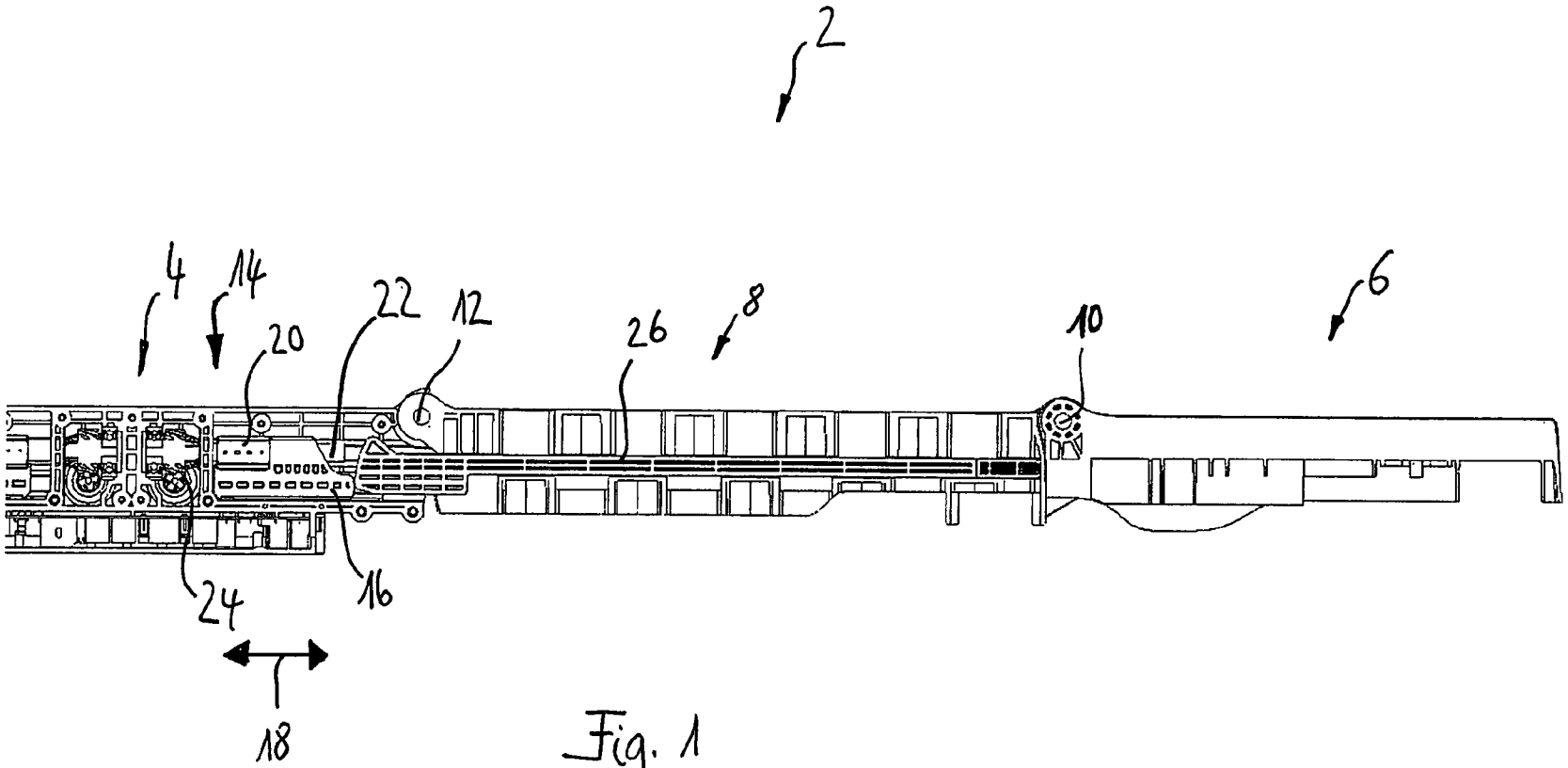
FIG. 1 shows, in a partially sectional side view, a first embodiment of a support device according to the invention in the form of a slatted frame, in a first adjustment position.

Identical or corresponding components are provided with the same reference numerals in the figures of the drawing.

The embodiments of the support device according to the invention illustrated in the figures are configured as slatted frames; for the sake of clarity, in each case only the base body of the slatted frame, without slats, is illustrated.

FIG. 1 illustrates in a partially sectional side view one embodiment of a support device 2 according to the invention in the form of a slatted frame, having a first support part 4 which in the present embodiment is formed by a stationary support part. The support device 2 also has a second support part 6, which in the present embodiment is formed by a head support part. In the longitudinal direction of the support device 2, a third support part 8 is provided between the first support part 4 and the second support part 6, and in the present embodiment is formed by an upper body support part. The figure illustrates only a portion of the support device 2 which is provided for supporting the upper body support part and head support part 8 and 6, respectively. A portion of the support device 2 which is provided for supporting the calf and thigh region has a similar configuration, and therefore is not explained in further detail.

The second support part 6 is connected in an articulated manner to the third support part 8 so as to be pivotable about a horizontal pivot axis 10, which in FIG. 1 extends into the plane of the drawing, and which is connected to the first support part 4 in an articulated manner so as to be pivotable about a horizontal pivot axis 12, which in FIG. 1 extends into the plane of the drawing. An electric motor drive 14, which is explained in greater detail below, is provided for pivoting the second support part 6 and the third support part 8 relative to one another and relative to the first support part 4.

The electric motor drive 14 has an adjusting element, which in the present embodiment is configured as a slider 16 which is movable back and forth in the direction of a double arrow 18. In the present embodiment, the slider 16 is connected in a nondisplaceable manner to a spindle nut 20 so as to be movable in the axial direction in a non-twisting (i.e., non-rotatable) manner on a threaded spindle 22 which is in rotary drive connection with an electric motor, not visible in FIG. 1, via a worm gear 24. The spindle nut 20 and therefore the slider 16 moves to the right or to the left in FIG. 1, corresponding to the rotational direction of the output shaft of the electric motor, and thus of the threaded spindle 22.

The slider 16 is connected in a force-transmitting manner to the second support part 6 via an actuating element 26 for pivoting the second support part. According to the invention, the actuating element 26 has a rod-like configuration, and by means of the slider 16, which may be termed a pusher or pushing element 16 as will be readily understood, is guided in a linearly displaceable manner in a guide which is formed in the third support part 8. In the illustrated embodiment, the slider 16 acts on the end of the rod-like actuating element facing away from the second support part 6, with play, in the present embodiment the actuating element being designed in the manner of a pusher. To avoid lateral buckling of the actuating element 26 when acted on by pressure (e.g., by compression pressure, as will be readily understood from the embodiment of FIG. 1 and the schematic diagrams of FIGS. 2A-2C) during pivoting of the second support part 6, either the actuating element 26 is narrowly led in the guide along its entire length, or guide elements are provided at short intervals in the longitudinal direction of the actuating element 26, the spacing between the guide elements being selected (i.e., configured) to be small enough that buckling of the actuating element 26 is avoided. The guide elements may have a web- or rib-like configuration, for example.

As is apparent from FIG. 1, the rod-like actuating element 26 engages with the second support part 6, eccentrically with respect to the pivot axis 10, in order to pivot the second support part 6.

Figure 2A:
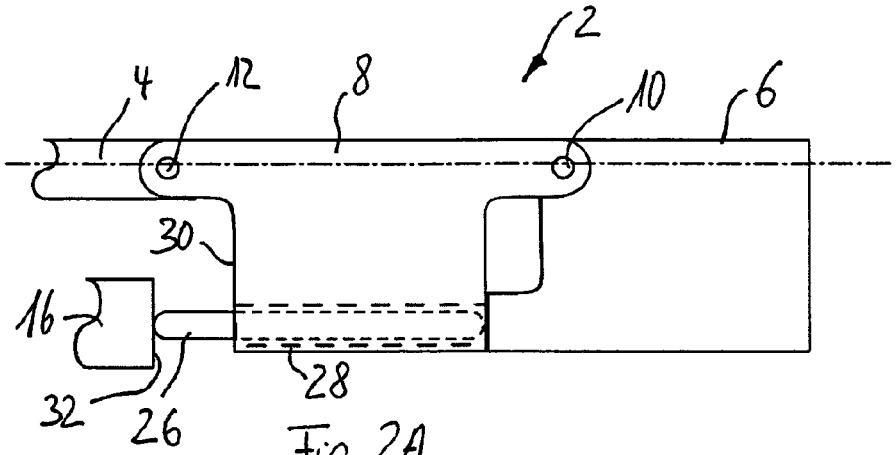
FIGS. 2A-2C show a schematic diagram for illustrating the basic principle of the invention.
Figure 2B:
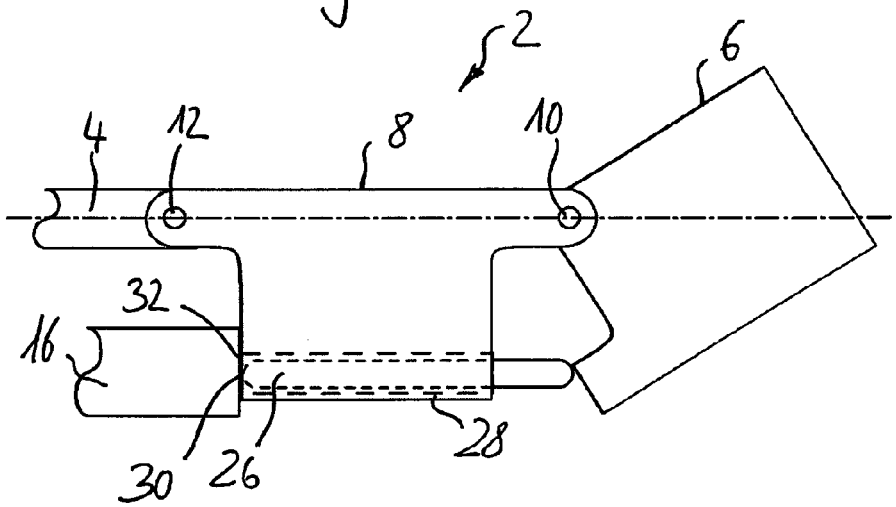
Figure 2C:
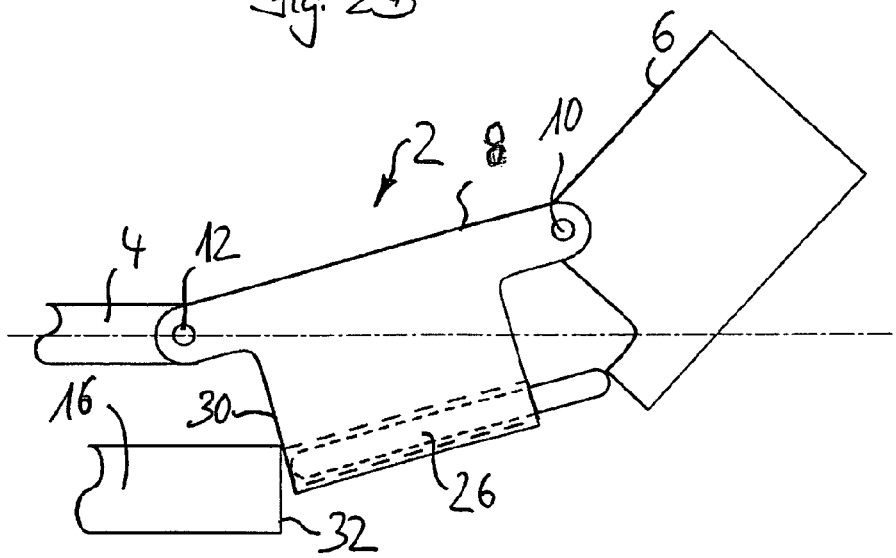

The underlying adjustment principle according to the invention is explained in greater detail below with reference to FIGS. 2A through 2C. FIGS. 2A through 2C are used solely for explaining the underlying adjustment principle; thus, the support parts 4, 6, 8 are shown in highly schematic form and are not illustrated to scale.

FIG. 2A shows the support parts 4, 6, 8 in an adjustment position in which the support parts 4, 6, 8 together span an essentially horizontal support plane. This adjustment position corresponds to an unadjusted position of the support device 2.

As indicated in FIG. 2A, at the third support part 8 the actuating element 26 is led in a guide 28 which is formed by a continuous channel-like recess, and is displaceably guided in its longitudinal direction at the third support part 8. At a distance from the guide 28, in the present embodiment the third support part 8 has a contact surface 30 at its end face which faces the slider 16, with which an active or working surface 32 of the slider 16 which faces the third support part 8 cooperates in a manner explained in greater detail below with reference to FIGS. 2B and 2C.

In a first kinematic phase, the slider 16 pushes against the actuating element 26, so that the actuating element is moved to the right in FIG. 2A. Since the end of the actuating element 28 facing away from the slider 32 engages with the second support part 6 eccentrically with respect to the pivot axis 10, the second support part 6 is pivoted in the counterclockwise direction.

FIG. 2B illustrates the end of the first kinematic phase, in which the second support part 6 is pivoted to the maximum extent in the counterclockwise direction relative to the third support part 8.

In a second kinematic phase, the active surface 32 of the slider 16 comes into contact with the contact surface 30 of the third support part 8. In the illustrated embodiment, for this purpose the cross section of the slider 16 at its free end, i.e., in the region of the active surface 32, is larger than the inner diameter of the guide 28, at least in one dimension. As a result of this configuration, in the second kinematic phase the actuating element 26 is not displaced further relative to the third support part 8. Instead, in the second kinematic phase the slider 16 pushes against the third support part 8, eccentrically with respect to the pivot axis 12, causing the third support part to pivot in the counterclockwise direction, as illustrated in FIG. 2C.

In this manner, with the aid of the actuating element the second support part 6 is pivoted, namely, in the first kinematic phase, and the third support part 8 is pivoted, namely, in the second kinematic phase.

As is apparent from FIGS. 2A through 2C, the slider 16 acts on the actuating element 26, and the actuating element 26 acts on the second support part 6, with play.

The support parts 6, 8 are returned to the starting position illustrated in FIG. 2A, corresponding to an unadjusted position of the support device 2, under the weight force of the support parts 6, 8, but with the drive switched on, whereby the spindle nut 20 and the slider 16 move to the left in FIG. 1.

Figure 3:
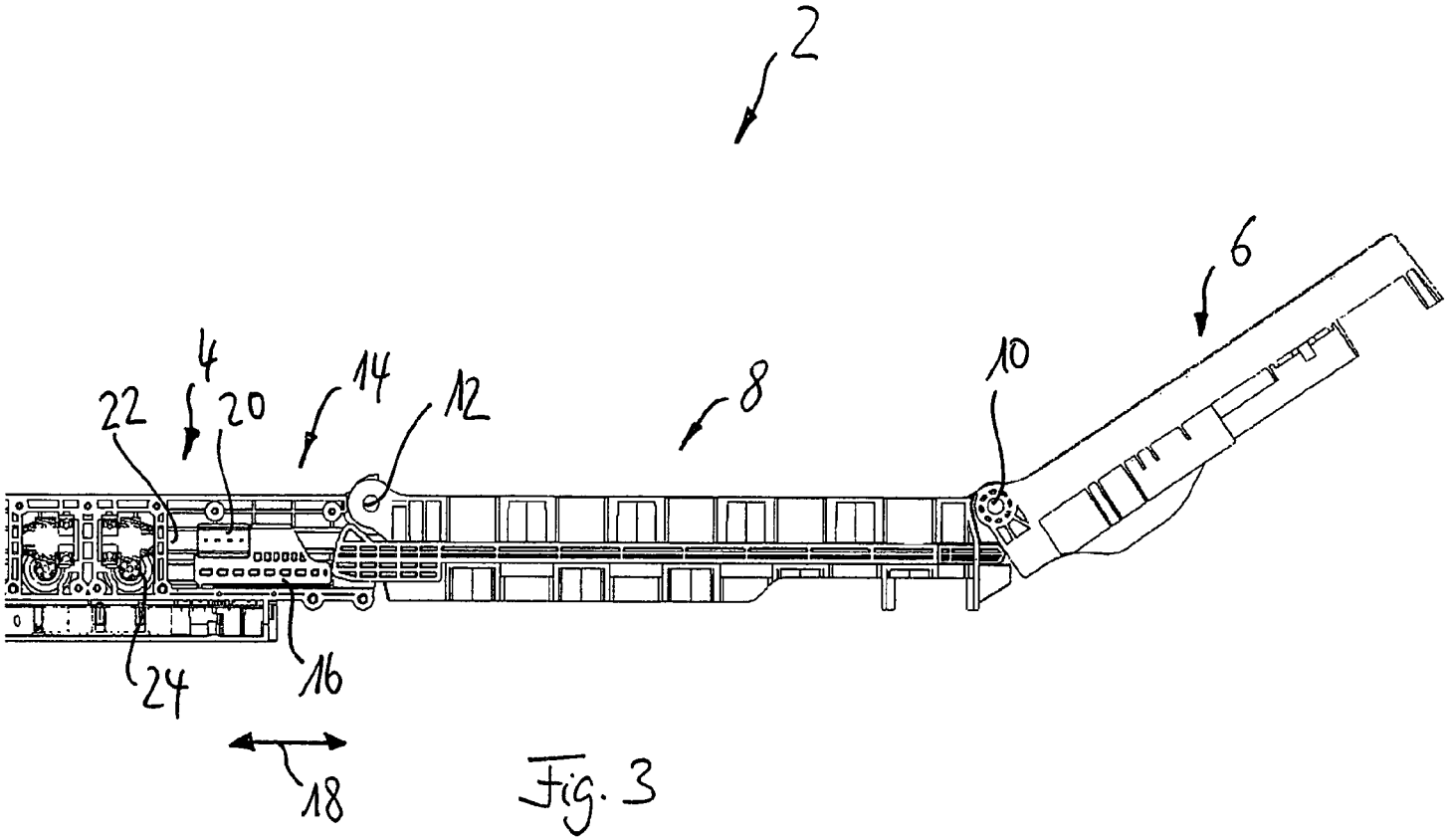
FIG. 3 shows, in the same representation as in FIG. 1, the support device according to the embodiment of FIG. 1 in a second adjustment position.

FIG. 3 shows the support device 2 according to FIG. 1 in a fixed position corresponding to FIG. 2B.

Figure 4:
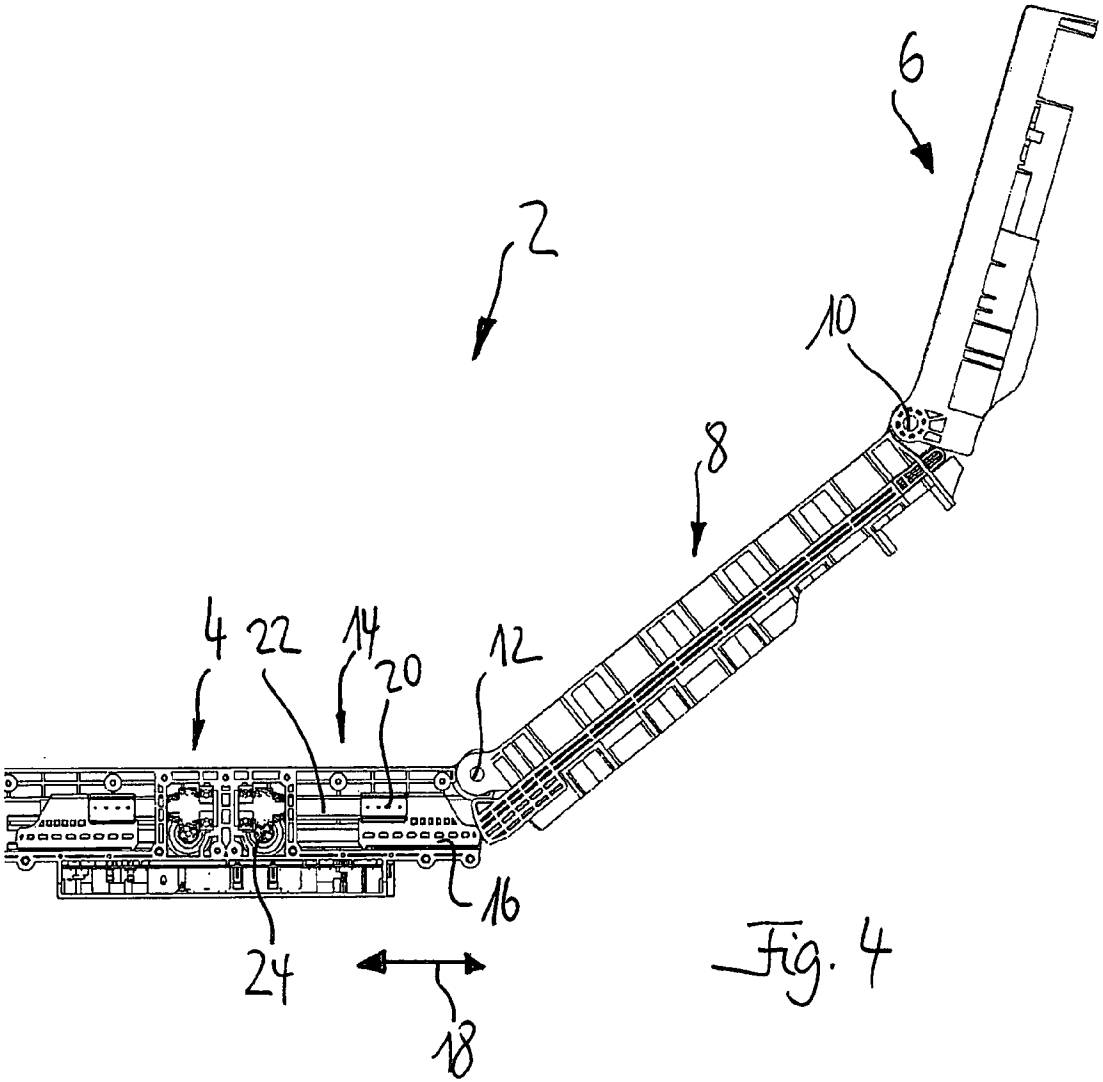
FIG. 4 shows, in the same representation as in FIG. 1, the support device according to FIG. 1 in a third adjustment position.

FIG. 4 shows the support device 2 according to FIG. 1 in an adjustment position corresponding to FIG. 2C, which corresponds to a maximum adjusted position of the support device 2.

As is apparent from FIGS. 1 through 4, the support device 2 according to the invention allows adjustment of the support parts 6, 8 by means of a relatively simple configuration. In addition, the support device 2 according to the invention has a small overall height.

Figure 5:
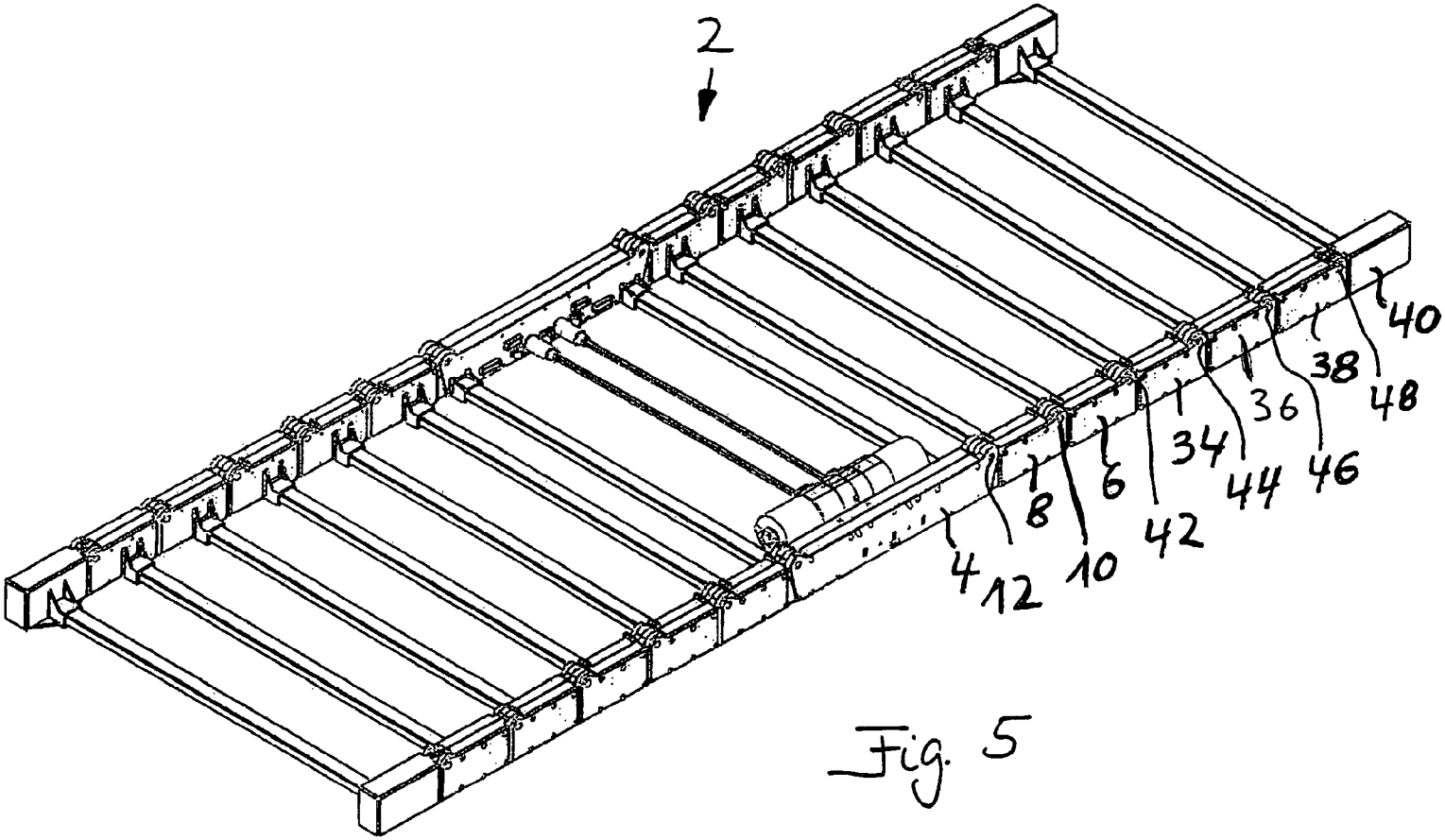
FIG. 5 shows a perspective view of a second embodiment of a support device according to the invention.

FIG. 5 illustrates a perspective view of a second embodiment of a support device 2 according to the invention, which differs from the embodiment according to FIG. 1 in that a fourth support part 34, a fifth support part 36, a sixth support part 38, and a seventh support part 40 are provided in addition to the first support part 4, the second support part 6, and the third support part 8. In each case, adjacent support parts 4-8 and 34-40 are connected to one another in an articulated manner so as to be pivotable about a horizontal pivot axis 12, 10, 42, 44, 46, or 48, respectively.

Figure 6A:
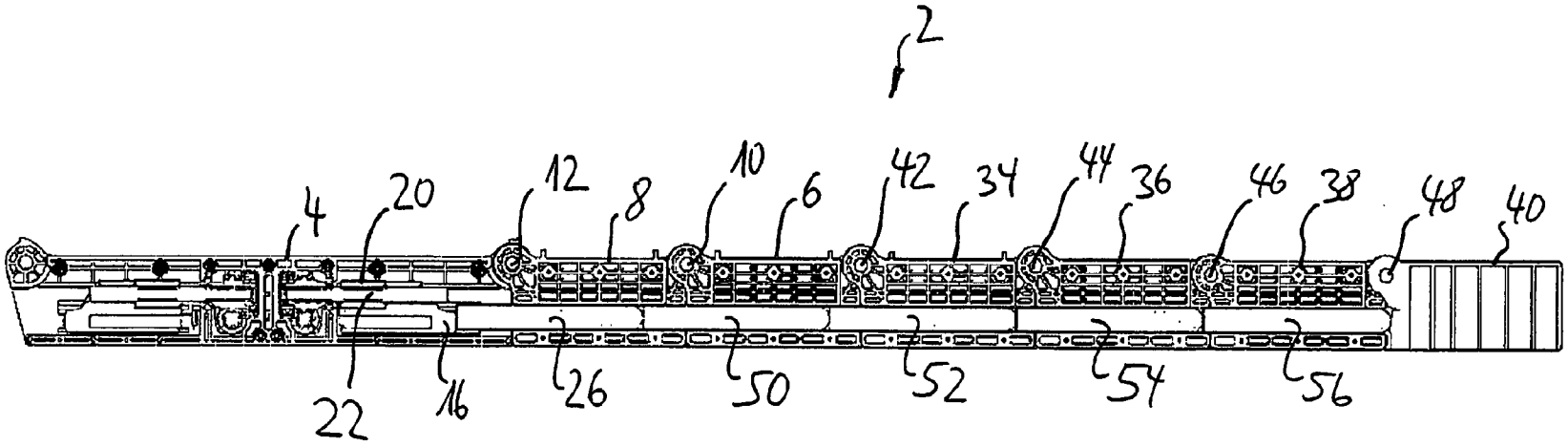
Figure 63:
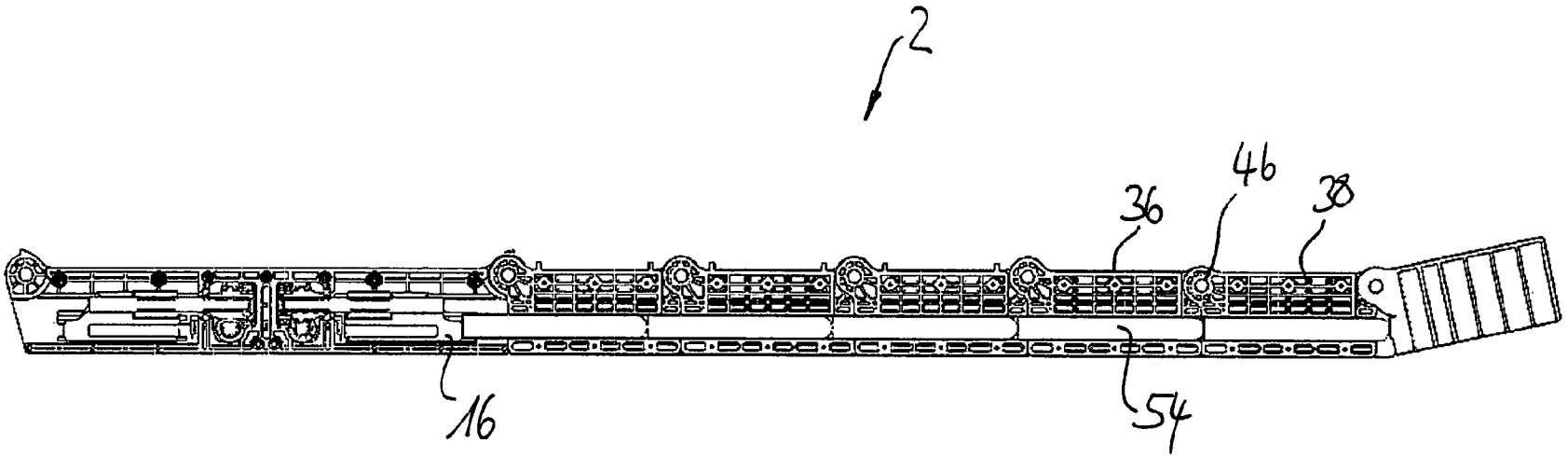

FIG. 6A shows the support device 2 according to FIG. 5 in a partially sectional side view, it being apparent that a further actuating element 50, 52, 54, or 56, each configured in the manner of a pusher, is associated with the respective further support part 34, 36, 38, or 40. In the illustrated embodiment, with regard to their structure and the cooperation with the associated actuating element the support parts 6, 34, 36, 38 have a configuration as described above with reference to the third support part 8. Similarly, the actuating elements 50, 52, 54, 56 have a configuration as described above with reference to the actuating element 26.

As is also apparent from FIG. 6A, in the adjustment position illustrated in FIG. 6A, in which the support parts 8, 6, 34, 36, 38, 40 span an essentially horizontal support plane and correspond to an unadjusted position of the support device 2, the end faces of the actuating elements 26, 50, 52, 54, 56 contact one another and the slider 16 and the support part 40, with play.

FIGS. 6B through 6G illustrate various kinematic phases during the adjustment of the support device 2. For the sake of clarity, essentially only the reference numerals of the components being referenced are provided in FIGS. 6B through 6F. To adjust the support parts of the support device 2, the threaded spindle 22 is rotationally driven in such a way that the spindle nut 20, and thus the slider 16, moves to the right in FIG. 6A. The slider 16 moves the actuating element 26 to the right in FIG. 6A, so that the latter likewise moves the actuating elements 50, 52, 54 and 56 to the right in FIG. 6A. Initially, the active surface of the actuating elements 26, 50, 52, 54 and of the slider 16 in each case is still at a distance from the contact surface of the associated support part 8, 6, 34, 36, 38 (see FIG. 2A), so that the support parts 8, 6, 34, 36, 38 initially remain unpivoted with respect to one another, while the support part 40 is pivoted in the counterclockwise direction in the figure until reaching the pivot position illustrated in FIG. 6B.

In the position of the actuating elements illustrated in FIG. 6B, the active surface of the actuating element 54 comes into contact with the contact surface of the associated sixth support part 38, eccentrically with respect to the pivot axis 46, so that the sixth support part 38 is pivoted in the counterclockwise direction in FIG. 6B about the pivot axis 46 relative to the fifth support part 36. The active surfaces of the slider 16 and of the actuating elements 26, 50, 52 are initially still at a distance from the contact surfaces of the associated support parts, so that the support parts 8, 6, 34, 36 are not pivoted initially.

Figure 6C:
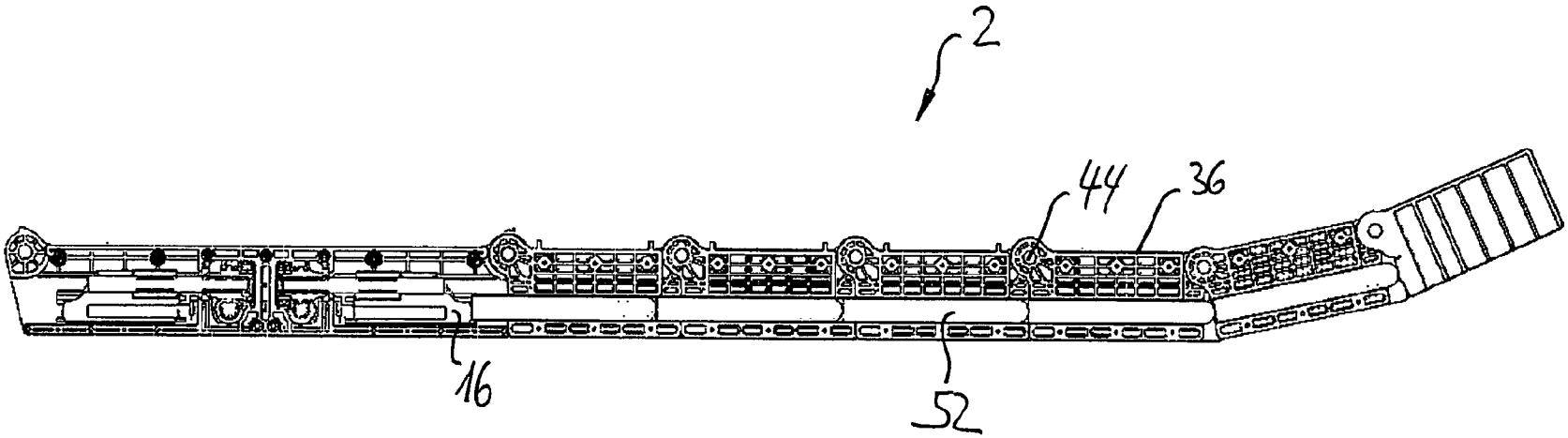

FIG. 6C illustrates an adjustment position in which the active surface of the actuating element 52 comes into contact with the contact surface of the fifth support part 36, eccentrically with respect to the pivot axis 44, so that the fifth support part 36 is pivoted in the counterclockwise direction in FIG. 6C upon further movement of the slider to the right in FIG. 6C.

Figure 6D:
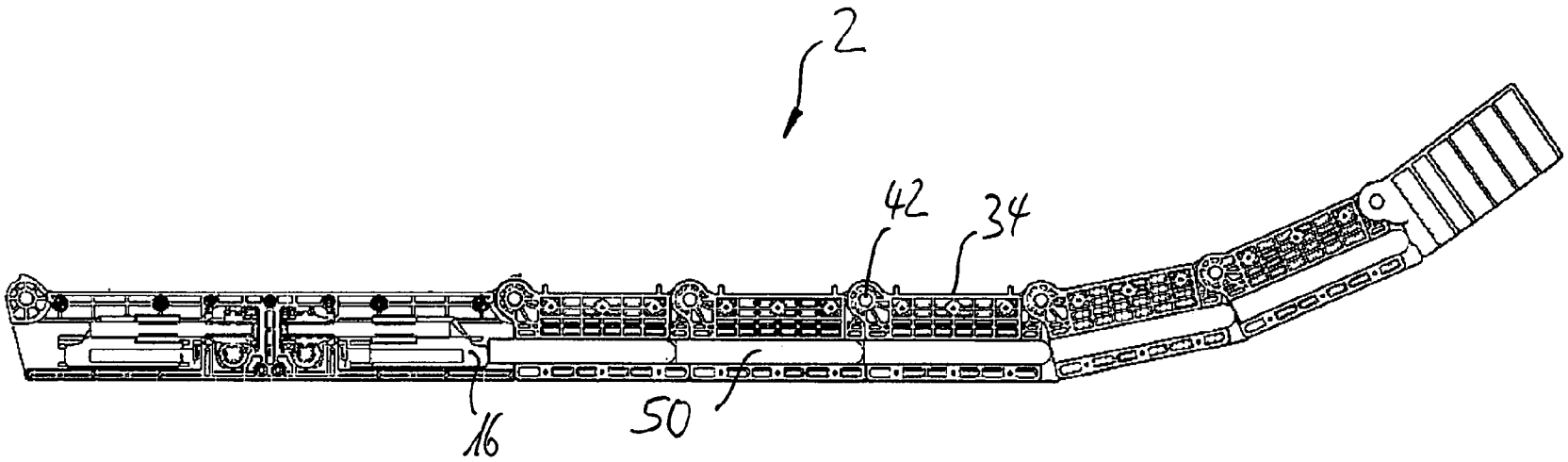

Upon further movement of the slider 16 to the right in FIG. 6C, the active surface of the actuating element 50 comes into contact with the contact surface of the associated fourth support part 34, eccentrically with respect to the pivot axis 42, so that the fourth support part 34 is pivoted in the counterclockwise direction in FIG. 6D about the pivot axis 42.

Figure 6E:
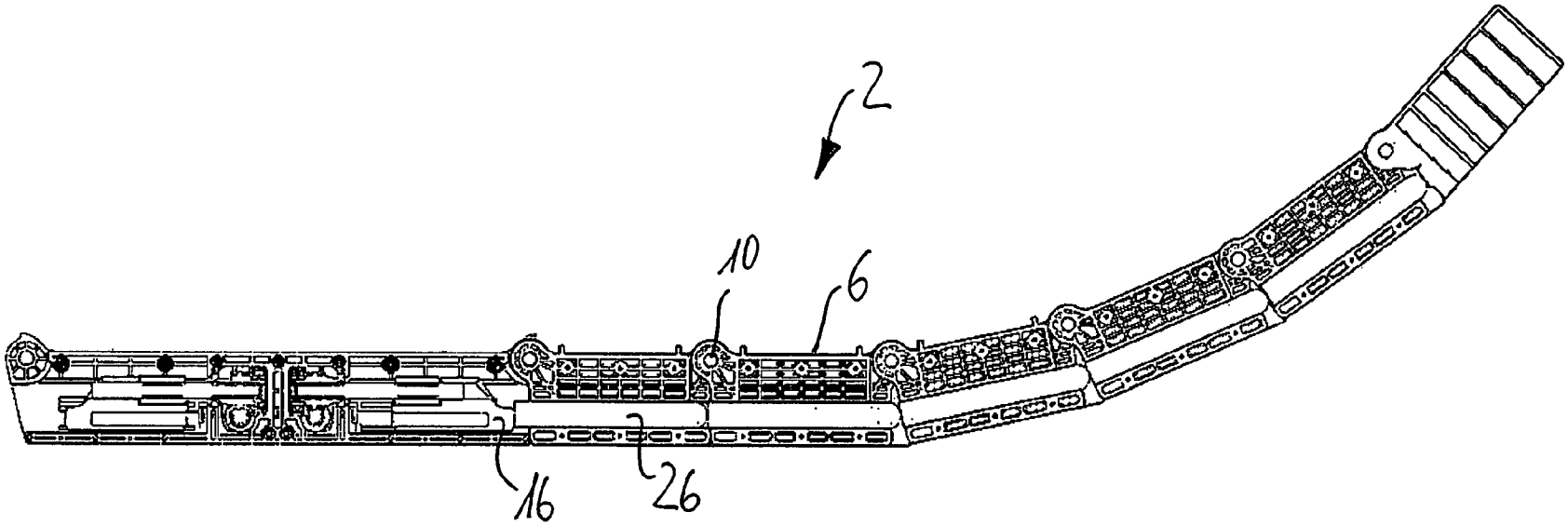

Upon further movement of the slider 16 in FIG. 6, in the position illustrated in FIG. 6E the active surface of the actuating element 26 comes into contact with the contact surface of the associated second support part 6, eccentrically with respect to the pivot axis 10, so that the second support part 6 is pivoted in the counterclockwise direction in FIG. 6E relative to the third support part 8.

Figure 6F:
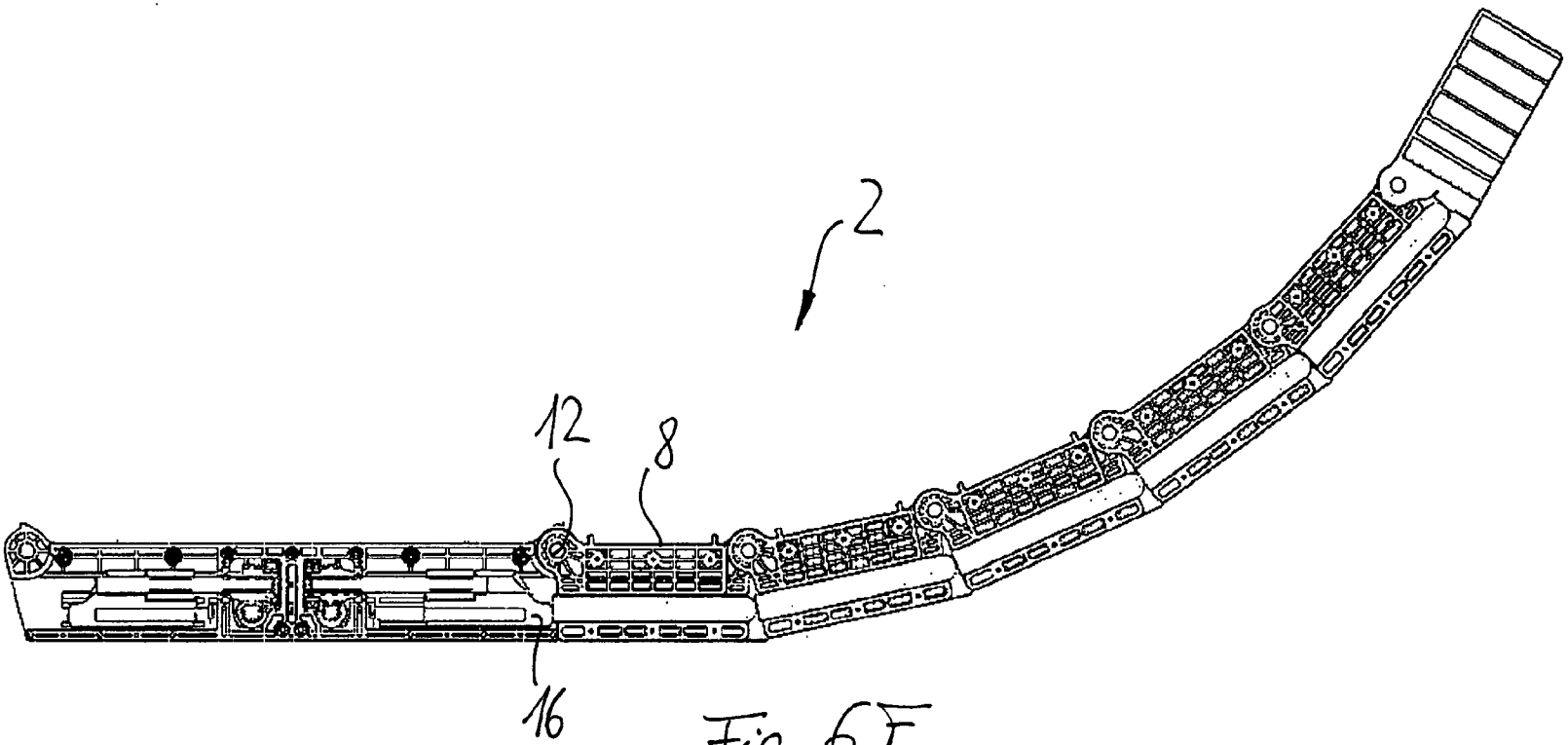

Upon further movement of the slider 16 to the right in FIG. 6E, in the position illustrated in FIG. 6F the active surface of the slider 16 comes into contact with the contact surface of the associated third support part 8, eccentrically with respect to the pivot axis 12, so that the third support part 8 is pivoted in the counterclockwise direction in FIG. 6F relative to the first support part 4.

Figure 6G:
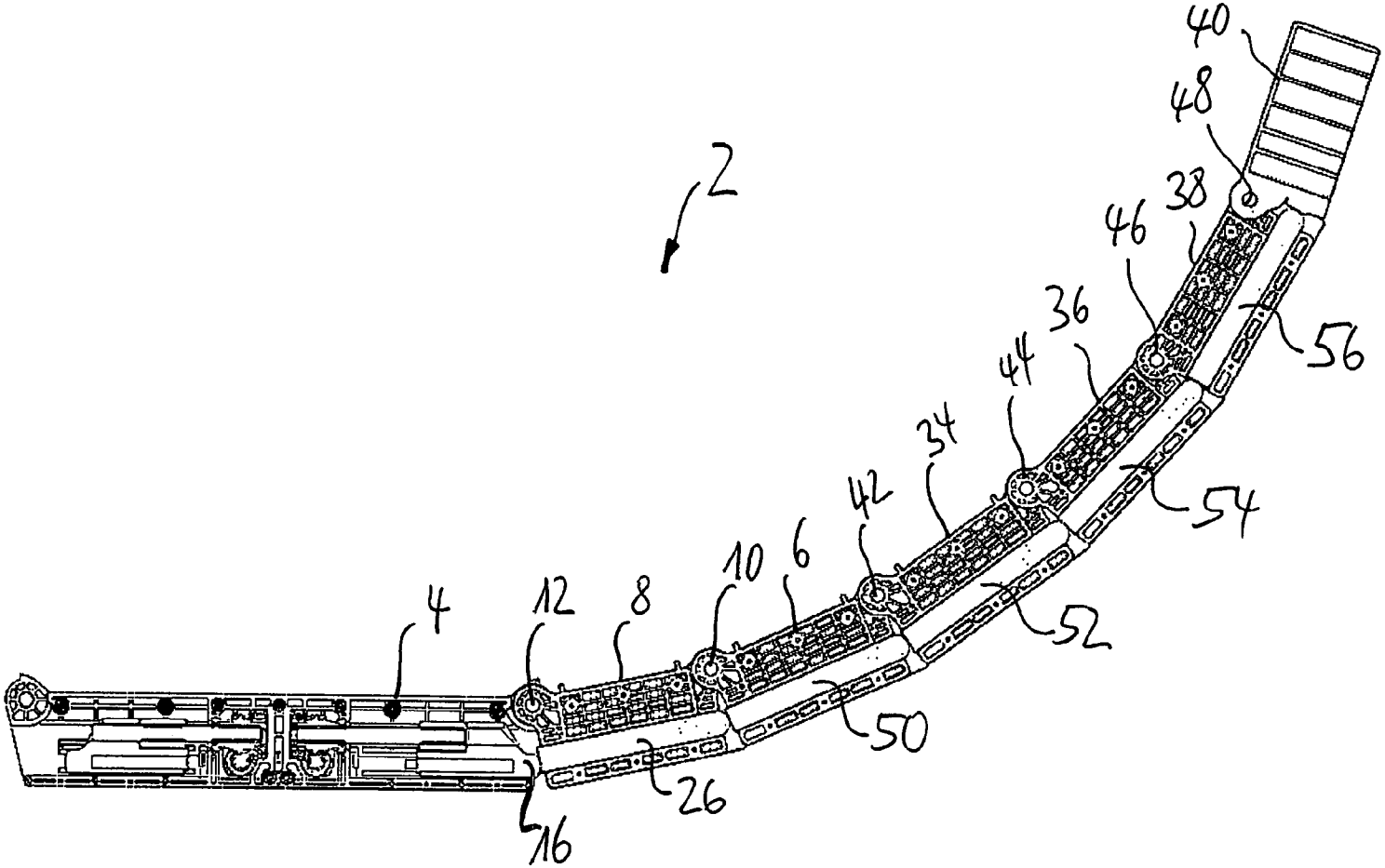

FIG. 6G illustrates the end position of the adjustment motion, which corresponds to a maximum adjusted position of the support parts of the support device 2.

It is apparent from the preceding description of FIGS. 6A through 6G that the support parts 40, 38, 36, 34, 6, 8 are pivoted in succession, starting with support part 40. An actuating element, for example actuating element 54, initially linearly moves the adjacent actuating element, for example actuating element 56, until the active surface of the actuating element comes into contact with the contact surface of the associated support part, for example the sixth support part 38. Upon further movement of the actuating element 54, the sixth support part 38 is then pivoted. This also applies in the described manner for the further actuating elements 56, 52, 50, 26, and the slider 16.

As is apparent from FIG. 6A, in the illustrated embodiment the actuating elements 26, 50, 52, 54, 56 have essentially the same length. As is further apparent from FIG. 6A, in the unadjusted position of the support device 2 the distance of the active surface of an actuating element from the contact surface of the associated support part, for example the distance of the active surface of the actuating element 56 from the contact surface of the associated support part 40, decreases from the actuating element which is closest to the slider 16, i.e., actuating element 26, to the actuating element which is farthest from the slider 16, namely, actuating element 56. The desired kinematics in each case are adjustable by an appropriate selection of the lengths of the actuating elements.

In a modification of the embodiment according to FIG. 6 it is possible, for example, to simultaneously increase the length of the actuating element 52 and decrease the length of the actuating element 54 in such a way that the active surface of the actuating element 54 comes into contact with the contact surface of the sixth support part 38 at the same time that the active surface of the actuating element 52 comes into contact with the contact surface of the associated fifth support part 36. In this case, the seventh support part 40 is pivoted relative to the sixth support part 38, while the support parts 36, 38 are not pivoted relative to one another. In this manner the kinematics of the support parts may be adapted to the particular requirements.

Figure 7A:
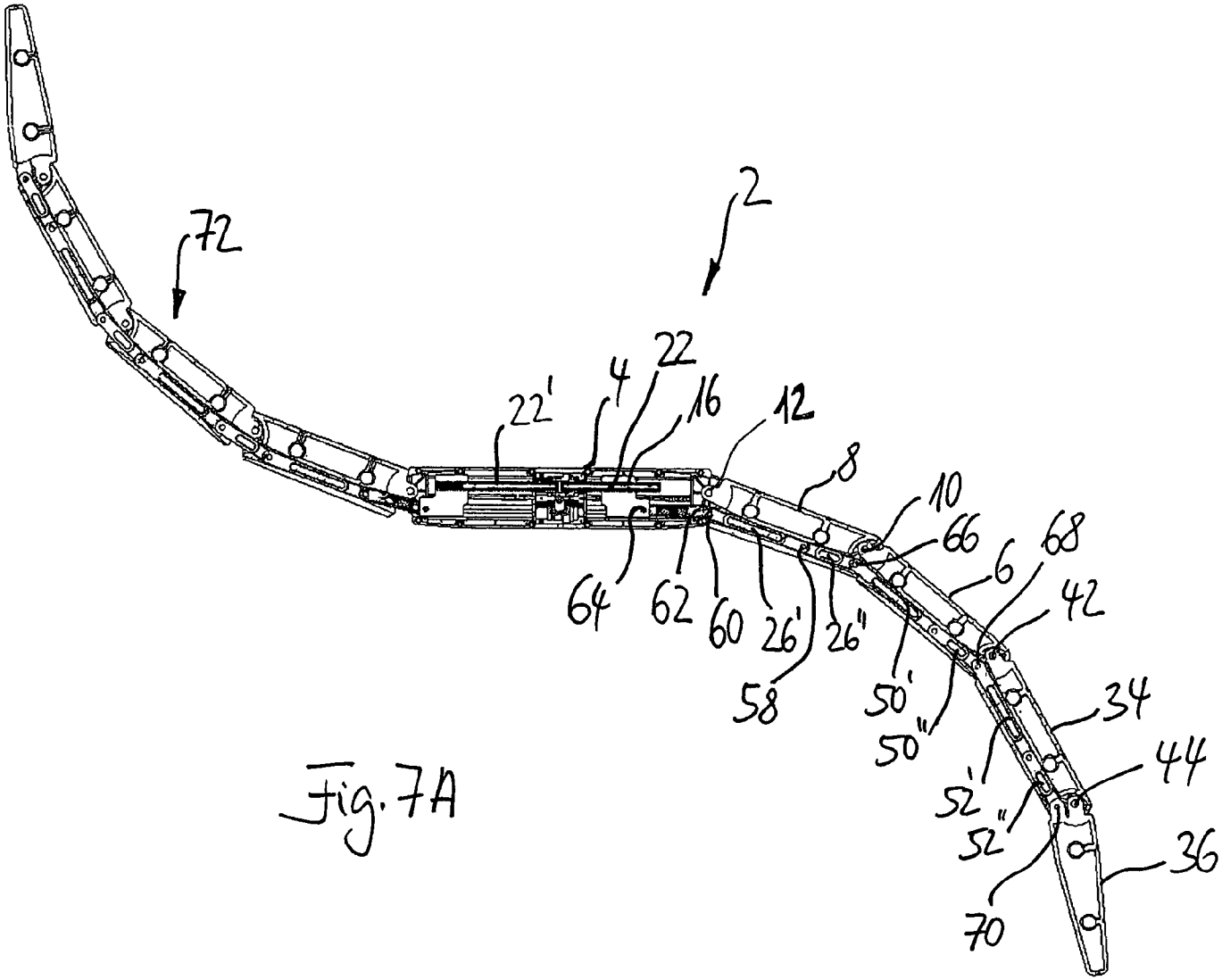
FIGS. 7A-7E show, in the same representation as in the embodiment of FIG. 1, a third embodiment of a support device according to the invention in various adjustment positions.
Figure 7B:
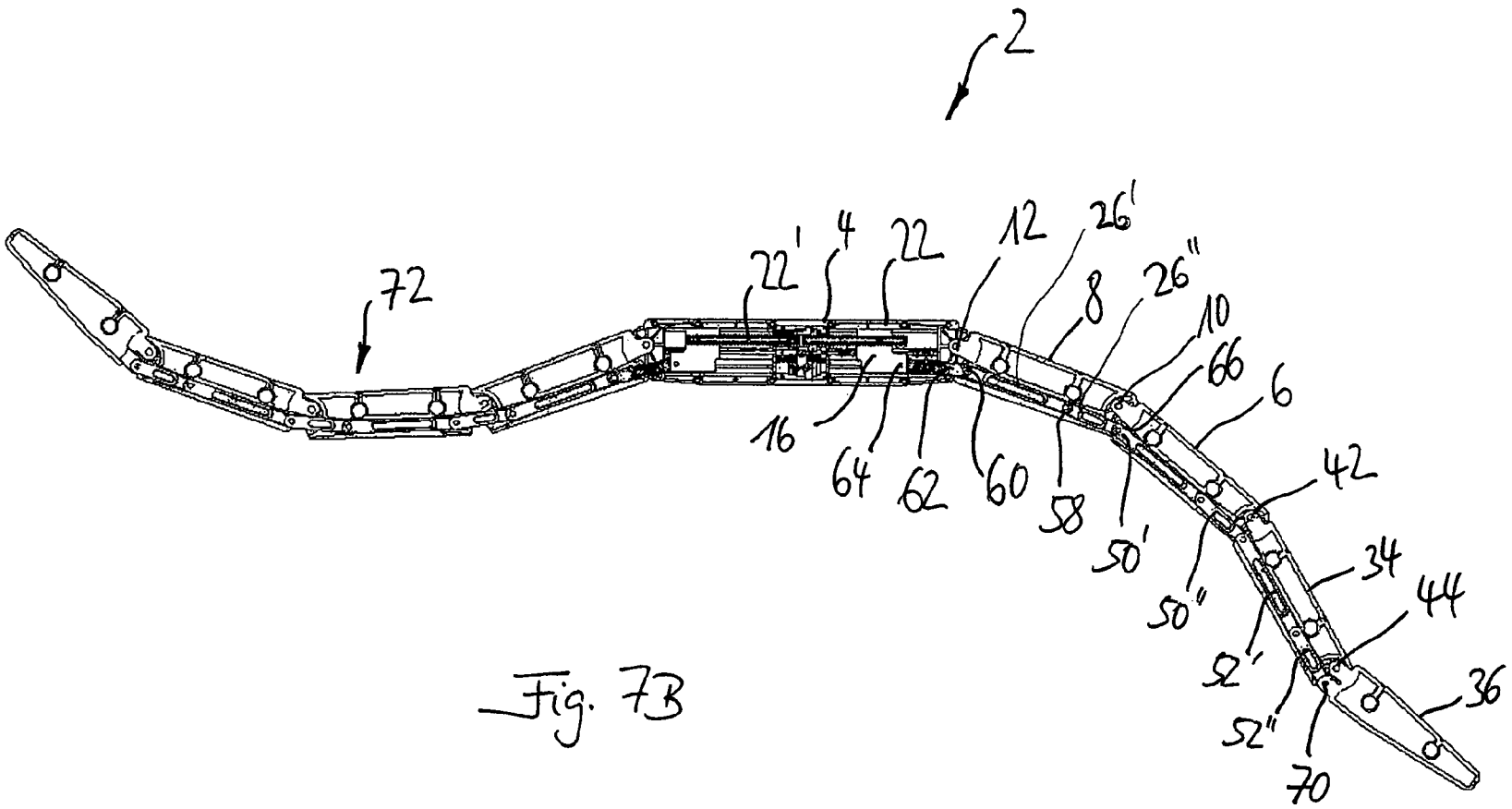
Figure 7C:
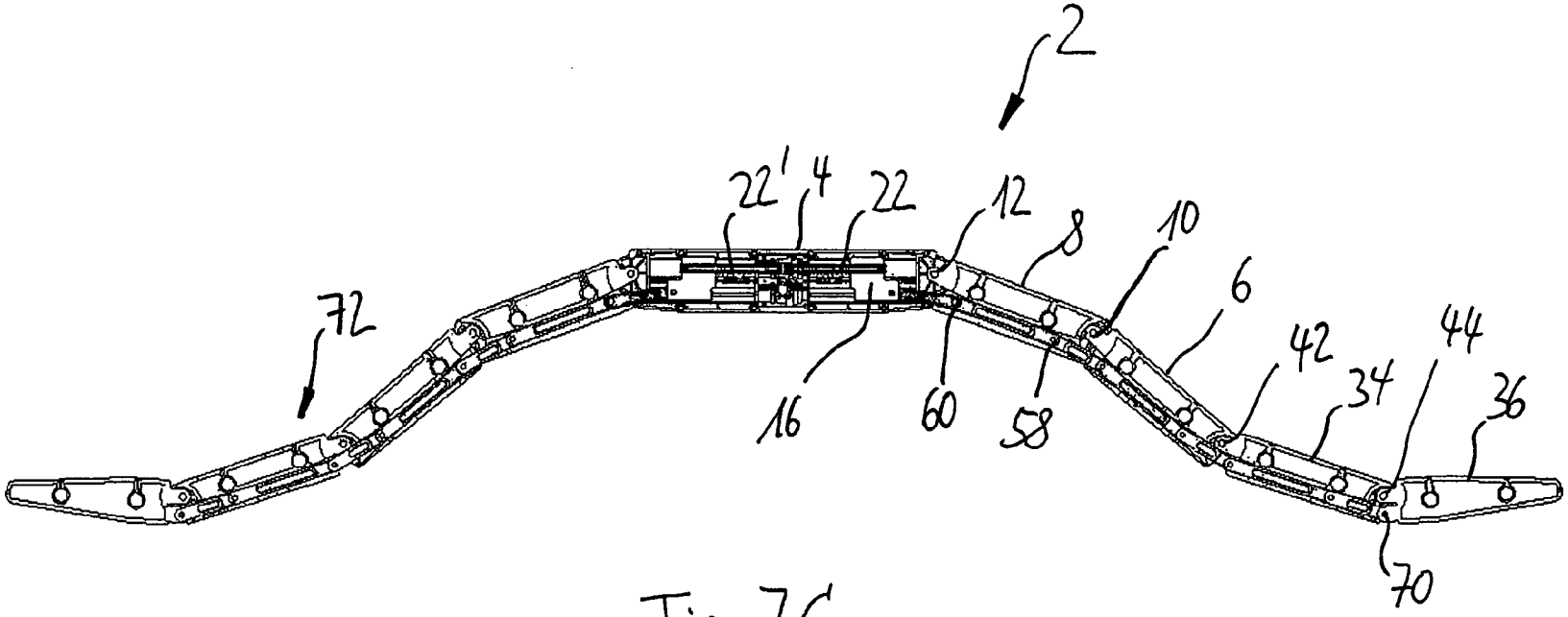
Figure 7D:
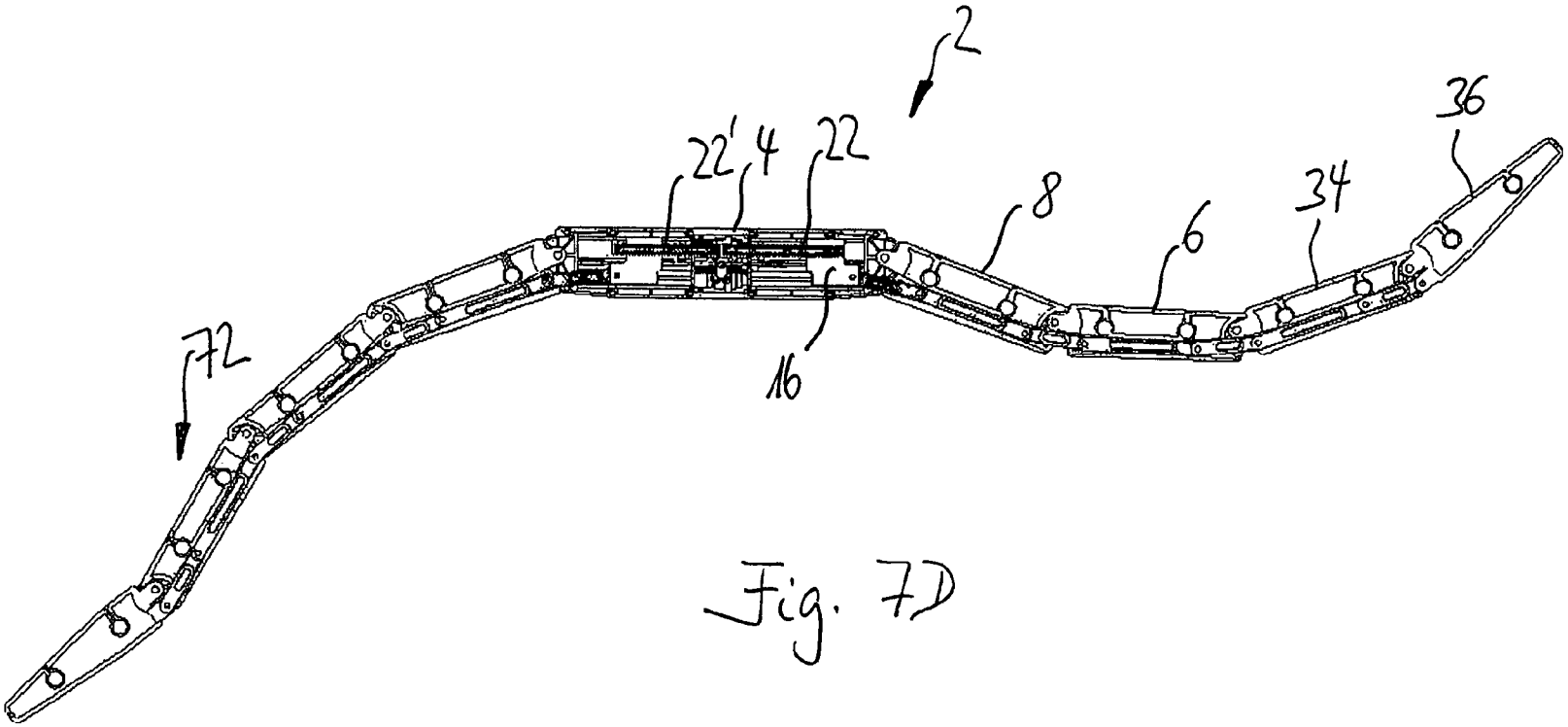

FIG. 7A illustrates a third embodiment of a support device 2 according to the invention, which for supporting a person resting on the support device 2 has four support parts 8, 6, 34, 36 in the region of the person's upper body and head, which, similarly to the second embodiment illustrated in FIG. 6, are connected to one another and to a stationary support part 4 about horizontal and mutually parallel pivot axes 12, 10, 42, 44. The embodiment according to FIG. 7A differs from the embodiment according to FIG. 6 primarily in that the rod-like actuating elements associated with the support parts 8, 6, 34, 36 are connected to another in a traction- and pressure-resistant manner. In the embodiment illustrated in FIG. 7A, the actuating element associated with the second support part 6 is formed by two rod-like actuating elements 26', 26" which are connected to one another in an articulated manner so as to be pivotable relative to one another about a pivot axis 58 which is parallel to an eccentric pivot axis 10. The end of the actuating element 26' facing away from the support part 6 is connected in an articulated manner to a further actuating element 62 about a pivot axis 60 which is parallel to the pivot axis 10, the end of the further actuating element facing away from the actuating element 26' being connected in an articulated manner to the slider 16 about a pivot axis 64 which is parallel to the pivot axis 10.

The end of the actuating element 26' facing away from the slider 16 is connected in an articulated manner to the actuating element 50' about a pivot axis 66 which is parallel to the pivot axis 10. Correspondingly, the actuating element 50" is connected in an articulated manner to the actuating element 52' about a pivot axis 68 which is parallel to the pivot axis 42. The end of the actuating element 52' facing away from the actuating element 52' is connected in an articulated manner to the support part 36 about a pivot axis 70 which is parallel to the pivot axis 44.

As is apparent from FIG. 7A, the pivot axis 60, for example, is provided eccentrically with respect to the pivot axis 12 in such a way that for pivoting the support part 8, the actuating element 62 engages with the support part 8, eccentrically with respect to the pivot axis 12. Correspondingly, the pivot axis 66 is provided eccentrically with respect to the pivot axis 10, the pivot axis 68 is provided eccentrically with respect to the pivot axis 42, and the pivot axis 70 is provided eccentrically with respect to the pivot axis 44.

Figure 7E:
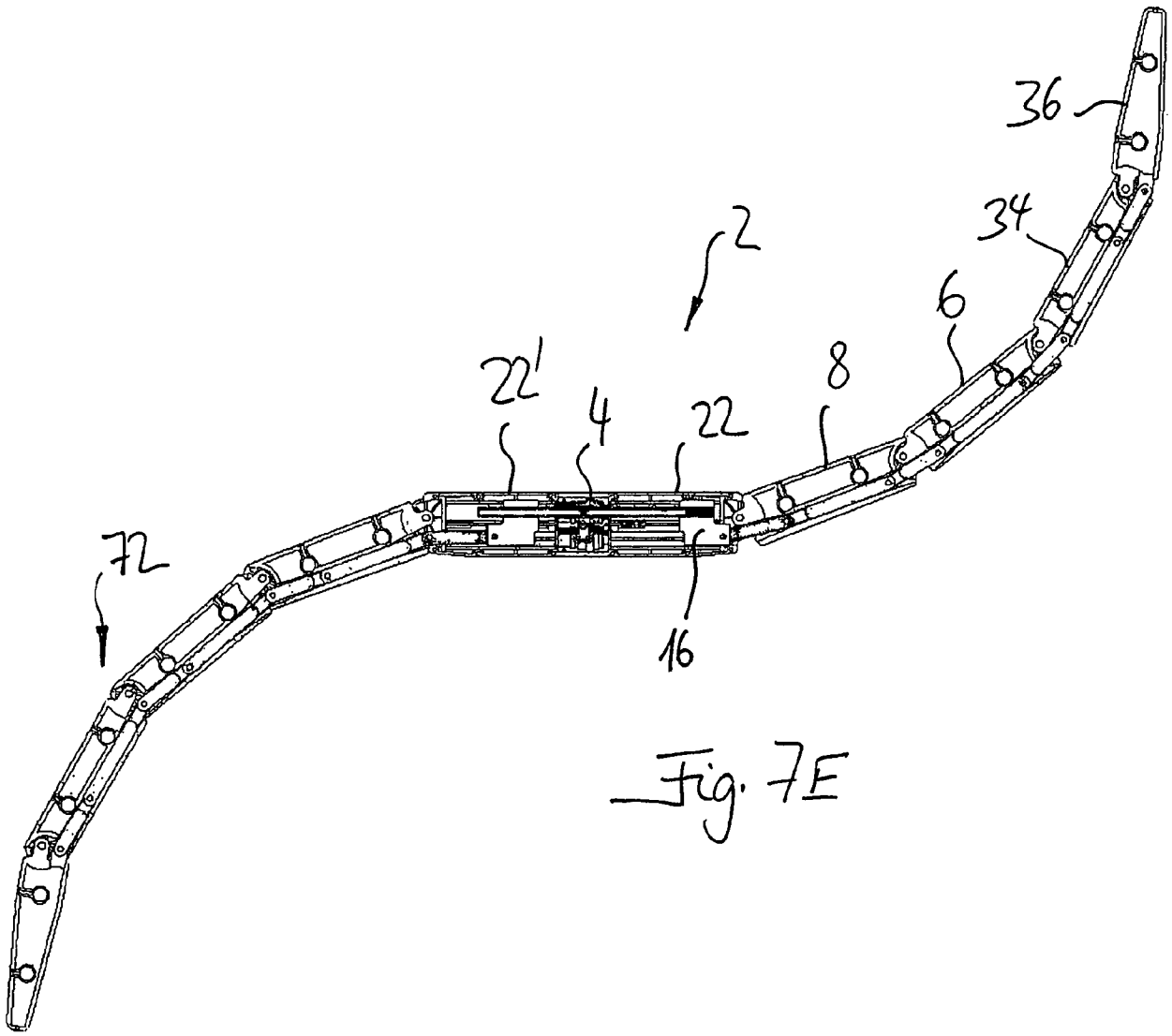

For adjusting the support parts 8, 6, 34, 36 from the adjustment position illustrated in FIG. 7A, the electric motor drives the threaded spindle 22 in such a way that the slider 16 is moved to the right in FIG. 7A, thus subjecting the actuating elements 62, 26', 26", 50', 50", 52', and 52" to pressure. Due to the configuration of the pivot axes 60, 66, 68, and 70 eccentrically with respect to the pivot axes 12, 10, 42, and 44, respectively, the support parts 8, 6, 34, 36 are pivoted in the manner illustrated in FIGS. 7B through 7E until the end position of the pivot motion illustrated in FIG. 7E is reached.

The adjustment of a support section 72 used for supporting a person, resting on the support device 2, in the calf/thigh region is carried out in a corresponding manner, and therefore is not explained in greater detail. A threaded spindle 22' associated with the support section 72 may be rotationally drivable independently of the threaded spindle 22, so that the support parts of the support section 72 are adjustable independently of the support parts 8, 6, 34, 36. However, the threaded spindles 22 and 22' may also be connected to one another in a rotationally fixed manner, so that the adjustment of the support parts of the support section 72 is coupled to the adjustment of the support parts 8, 6, 34, 36. For example and in particular, one of the threaded spindles 22, 22' may then have a left-handed thread, and the other may have a right-handed thread.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. Support device, which is adjustable by an electric motor, for cushioning of a piece of furniture for one of sitting and lying on, comprising:

a) a first support part, and a second support part which is pivotable about a pivot axis, and between which a third support part is provided;

b) an electric motor drive which has an adjusting element that is connected in a force-transmitting manner to the second support part via an actuating element in order to pivot the second support part;

c) the actuating element having a rod-like configuration, by which the adjusting element guides the actuating element in a linearly displaceable manner in a guide formed in or on the third support part;

d) the actuating element engaging with the second support part in order to pivot the second support part eccentrically with respect to the pivot axis; and e) the third support part has a contact surface provided at a distance from the guide, so that, in a first kinematic phase, an active surface of the adjusting element provided at an adjacent first support part comes into contact with the actuating element and linearly displaces same and pivots the second support part eccentrically with respect to the pivot axis, and in a second kinematic phase the active surface of the adjusting element provided at the adjacent first support part comes into contact with the contact surface of the third support part and pivots the third support part about a pivot axis.

2. Support device according to claim 1, wherein:

a) a fourth support part which is pivotable about a further pivot axis is provided, and a further actuating element is associated with the fourth support part and is guided in a linearly displaceable manner in a guide formed in or on the second support part adjacent to the fourth support part, the further actuating element engaging with the fourth support part in order to pivot the fourth support part eccentrically with respect to the further pivot axis.

3. Support device according to claim 1, wherein:

a) the adjusting element acts on the actuating element, or the actuating element acts on an adjacent further actuating element, or the actuating element acts on the associated one of the first, second, and third support parts, with play.

4. Support device according to claim 1, wherein:

a) the actuating element is configured as a pushing element.

5. Support device according to claim 1, wherein:

a) the adjusting element includes a spindle nut, or is connected to a spindle nut, which is provided on a rotationally drivable threaded spindle so that the spindle nut is movable in a non-rotatable manner in the axial direction.

6. Support device according to claim 2, wherein:

a) the lengths of the actuating element and the further actuating element and in each case the distance of the active surface of the actuating element and the further actuating element from the contact surface of the associated first, second, third, and fourth support parts in an unadjusted position of the first, second, third, and fourth support parts, are dimensioned in such a way that the first, second, third, and fourth support parts pivot in succession.

7. Support device according to claim 1, wherein:

a) the length of the actuating element and in each case the distance of the active surface of the actuating element from the contact surface of the associated one of the first, second, and third support parts in the unadjusted position of the associated one of the first, second, and third support parts, are dimensioned in such a way that the associated one of the first, second, and third support parts pivot simultaneously or essentially simultaneously.

8. Support device according to claim 2, wherein:

a) the actuating element and the further actuating element are essentially the same length.

9. Support device according to claim 2, wherein:

a) the distance of the active surface of the actuating element and the further actuating element from the contact surface of the associated one of the first, second, third, and fourth support parts decreases from the one of the actuating element and the further actuating element closest to the adjusting element to the actuating element and the further actuating element farthest from the adjusting element.

10. Support device according to claim 1, wherein:

a) the support device is configured as a slatted frame in which the support parts have elastic slats for supporting a bed mattress.

11. Support device according to claim 1, wherein:

a) the support device is configured as a recliner.

12. Support device according to claim 1, wherein:

a) the support device is configured as an outdoor lounge recliner.

13. Support device according to claim 1, wherein:

a) the guide in which the adjusting element is guided in a linearly displaceable manner includes a narrow guide configured to avoid lateral buckling of the actuating element.

* * * * *